US005692101A

United States Patent [19]

Gerson et al.

[11] Patent Number: 5,692,101

[45] Date of Patent: Nov. 25, 1997

[54] SPEECH CODING METHOD AND APPARATUS USING MEAN SQUARED ERROR MODIFIER FOR SELECTED SPEECH CODER PARAMETERS USING VSELP TECHNIQUES

[75] Inventors: Ira A. Gerson, Schaumburg; Mark A. Jasiuk, Chicago; Matthew A. Hartman, Bloomington, all of Ill.

[73] Assignee: Motorola, Inc., Schaumburg, Ill.

[21] Appl. No.: 560,857

[22] Filed: Nov. 20, 1995

[51] Int. Cl.[6] ..... G10L 9/14

[52] U.S. Cl. ..... 395/2.31; 395/2.28; 395/2.34; 395/2.32; 395/2.39

[58] Field of Search ..... 395/2.28, 2.34, 395/2.38, 2.09, 2.16, 2.31, 2.32, 2.1

[56] References Cited

U.S. PATENT DOCUMENTS

| | | | |
|---|---|---|---|
| 4,896,361 | 1/1990 | Gerson et al. | 395/2.31 |
| 5,097,508 | 3/1992 | Valenzuela Steude et al. | 395/2.32 |
| 5,125,030 | 6/1992 | Nomura et al. | 395/2.31 |
| 5,261,027 | 11/1993 | Taniguchi et al. | 395/2.09 |
| 5,263,119 | 11/1993 | Tanaka et al. | 395/2.32 |
| 5,359,696 | 10/1994 | Gerson et al. | 395/2.32 |
| 5,371,853 | 12/1994 | Kao et al. | 395/2.32 |
| 5,490,230 | 2/1996 | Gerson et al. | 395/2.34 |
| 5,528,723 | 6/1996 | Gerson et al. | 395/2.2 |

OTHER PUBLICATIONS

Gerson et al., ("Vector Sum Excited Linear Prediction (VSELP) Speech Codingat 8 KBPS", ICASSP '90: Acoustics, Speech & Signal Processing Conference, Feb. 1990, pp. 461–464).

*Primary Examiner*—Allen R. MacDonald
*Assistant Examiner*—Vijay B. Chawan
*Attorney, Agent, or Firm*—John G. Rauch; Kirk W. Dailey

[57] ABSTRACT

An improved speech coder provides a more natural sounding replication of speech by modifying the mean-squared error criterion for the selected speech coder parameters. Specifically, the modification emphasizes the signal components that the speech coder has difficulty matching, i.e. the high frequencies. This emphasis is constrained to certain limitations to avoid over-emphasizing the speech.

13 Claims, 2 Drawing Sheets

SPEECH CODING METHOD AND APPARATUS USING MEAN SQUARED ERROR MODIFIER FOR SELECTED SPEECH CODER PARAMETERS USING VSELP TECHNIQUES

FIELD OF THE INVENTION

The present invention generally relates to speech coders using Code Excited Linear Predictive Coding (CELP), Stochastic Coding or Vector Excited Speech Coding and more specifically to vector quantizers for Vector-Sum Excited Linear Predictive Coding (VSELP).

BACKGROUND OF THE INVENTION

Code-excited linear prediction (CELP) is a speech coding technique used to produce high quality synthesized speech. This class of speech coding, also known as vector-excited linear prediction, is used in numerous speech communication and speech synthesis applications. CELP is particularly applicable to digital speech encrypting and digital radiotelephone communications systems wherein speech quality, data rate, size and cost are significant issues.

In a CELP speech coder, the long-term (pitch) and the short-term (formant) predictors which model the characteristics of the input speech signal are incorporated in a set of time varying filters. Specifically, a long-term and a short-term filter may be used. An excitation signal for the filters is chosen from a codebook of stored innovation sequences, or codevectors.

For each frame of speech, an optimum excitation signal is chosen. The speech coder applies an individual codevector to the filters to generate a reconstructed speech signal. The reconstructed speech signal is compared to the original input speech signal, creating an error signal. The error signal is then weighted by passing it through a spectral noise weighting filter. The spectral noise weighting filter has a response based on human auditory perception. The optimum excitation signal is a selected codevector which produces the weighted error signal with the minimum energy for the current frame of speech.

Speech coders typically use the minimization of the Mean Squared Error (MSE) as the criterion for selecting the speech coder's parameters. Although MSE is a computationally convenient error criterion, it tends to deemphasize the signal components that it has a difficulty matching. In CELP speech coders, the deemphasis is manifested in suppression of those signal components which are more difficult to code. Consequently, the energy in the synthetic speech tends to be lower than the energy in the input speech for speech segments which are more difficult to code. Thus, it would be advantageous to modify the MSE criterion to provide a more accurate representation of the energy contour of the input speech; providing a better synthesis of the speech and a more natural sounding coded

DESCRIPTION OF A PREFERRED EMBODIMENT

A speech coding method and apparatus includes a MSE (mean square error) modifier for improving the quality of recovered speech. After selecting the Codeword I, corresponding gains, $\gamma$, and $\beta$, are chosen, using the gain bias factor $\chi$, so as to minimize the total weighted error energy, E, as described below. In the preferred embodiment, the MSE modifier is utilized for two excitation sources, the given methodology may be extended to the case where an arbitrary number of excitation sources are used.

Figure 1:
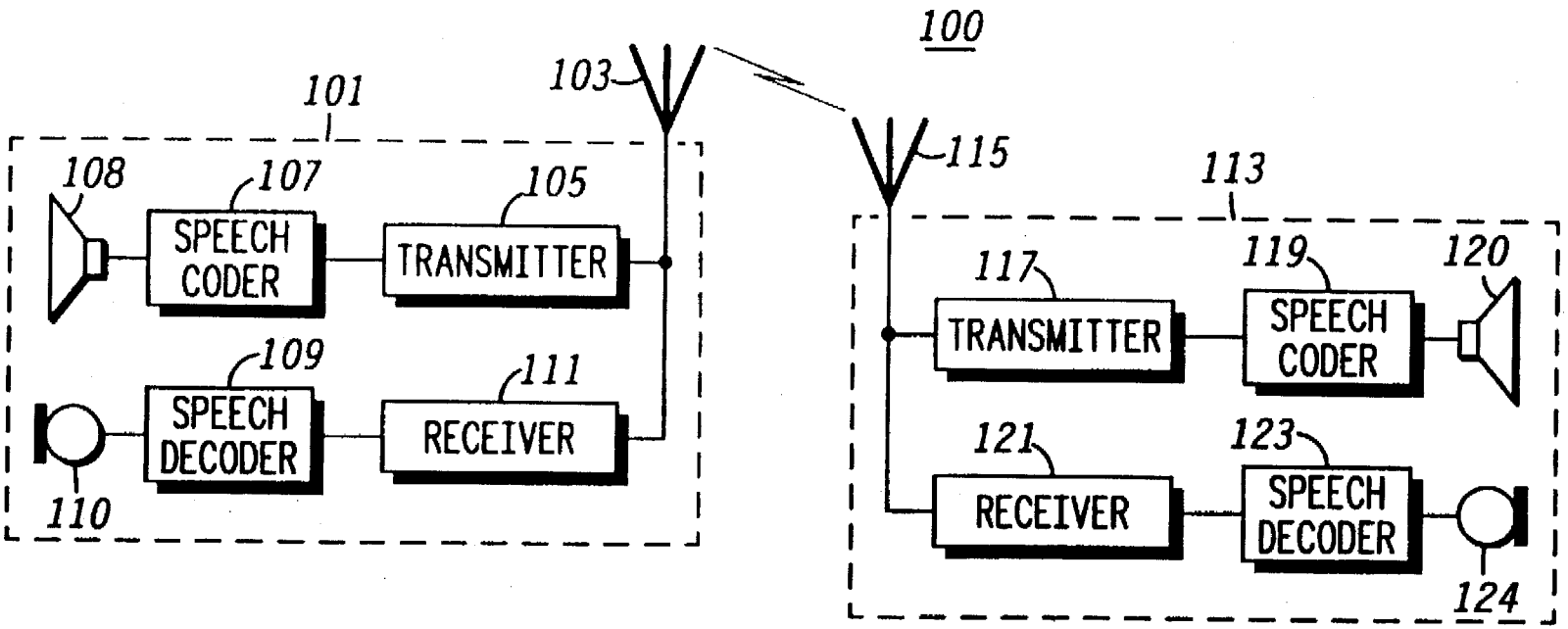
FIG. 1 is an illustration in block diagram form of a radiotelephone system in accordance with the present invention.

FIG. 1 is an illustration in block diagram form of a radio communication system 100. The radio communication system 100 includes two transceivers 101, 113 which transmit and receive speech data to and from each other. The two transceivers 101, 113 may be part of a trunked radio system or a radiotelephone communication system or any other radio communication system which transmits and receives speech data. At the transmitter, the speech signals are input into microphone 108, and the speech coder selects the quantized parameters of the speech model. The codes for the quantized parameters are then transmitted to the other transceiver 113 via a radio channel. At the other transceiver 113, the transmitted codes for the quantized parameters are received by a receiver 121 and used to regenerate the speech in the speech decoder 123. The regenerated speech is output to the speaker 124.

Figure 2:
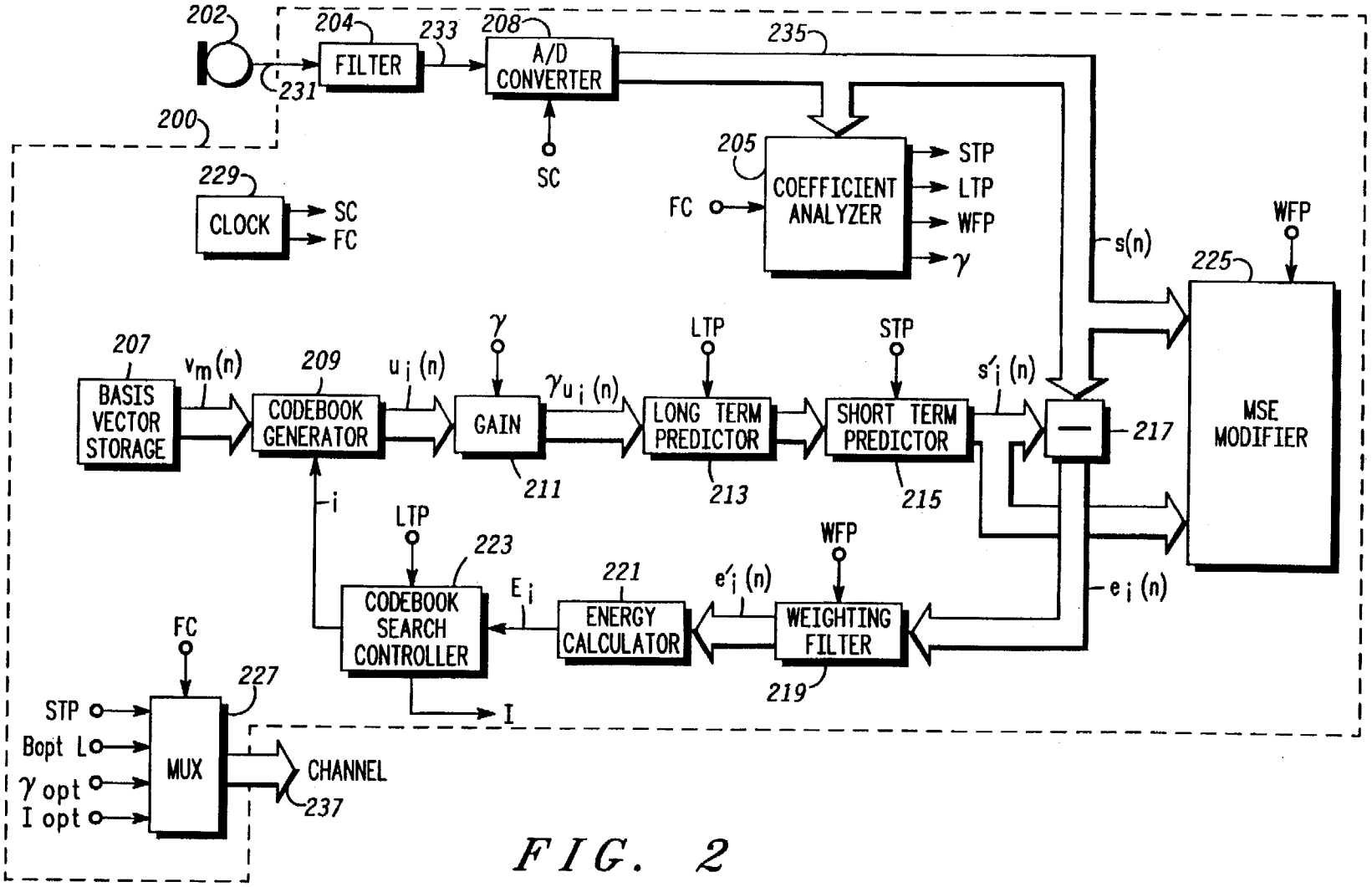
FIG. 2 is an illustration in block diagram form of a speech coder from FIG. 1 in accordance with the present embodiment.

FIG. 2 is a block diagram of a first embodiment of a speech coder 200 employing the present invention. Such a speech coder 200 could be used as speech coder 107 or speech coder 119 in the radio communication system 100 of FIG. 1. An acoustic input signal to be analyzed is applied to speech coder 200 at microphone 202. The input signal, typically a speech signal 231, is then applied to filter 204. Filter 204 generally will exhibit bandpass filter characteristics. However, if the speech bandwidth is already adequate, filter 204 may comprise a direct wire connection.

An analog-to-digital (A/D) converter 208 converts the filtered speech signal 233 output from filter 204 into a sequence of N pulse samples, the amplitude of each pulse sample is then represented by a digital code, as is known in the art. A sample clock signal, SC, determines the sampling rate of the A/D converter 208. In the preferred embodiment, the sample clock signal, SC, operates at 8 KHz. The sample clock signal, SC, is generated along with a frame clock signal, FC, in the clock module 229.

The digital output of A/D 208, referred to as input speech vector, s(n), 235, is applied to a coefficient analyzer 205. This input speech vector 235 is repetitively obtained in separate frames, i.e., lengths of time, the length of which is determined by the frame clock signal, FC. For each block of speech, a set of linear predictive coding (LPC) parameters is produced by coefficient analyzer 205. In the preferred embodiment, the LPC parameters include a short term predictor (STP), a long term predictor (LTP), a weighting filter parameter (WFP), and an excitation gain factor ($\gamma$). The LPC parameters are optimized during the speech coding process. The optimized LPC parameters are applied to a multiplexer 227 and sent over a radio channel for use by a speech decoder such as speech decoder 109 or speech decoder 123. The input speech vector, 235 is also applied to subtractor 217 and the MSE modifier 225, the functions of which will subsequently be described.

Basis vector storage 207 contains a set of M basis vectors $V_m(n)$, wherein $1 \leqq m \leqq M$, each comprised of n samples, wherein $1 \leqq n \leqq N$. These basis vectors are used by a codebook generator 209 to generate a set of $2^M$ pseudo-random excitation vectors $u_i(n)$, wherein $0 \leqq I \leqq 2^{M-1}$. Each of the M basis vectors are comprised of a series of random white Gaussian samples, although other types of basis vectors may be used.

Codebook generator 209 utilizes the M basis vectors $V_m(n)$ and a set of $2^M$ excitation codewords $I_i$, where $0 \leqq I \leqq 2^M-1$, to generate the $2^M$ excitation vectors $u_i(n)$. In the present embodiment, each codeword $I_i$ is equal to its index i, that is, $I_i=i$. If the excitation signal were coded at a rate of 0.25 bits per sample for each of the 40 samples (such that M=10), then there would be 10 basis vectors used to generate the 1024 excitation vectors.

For each individual excitation vector $u_i(n)$, a reconstructed speech vector $s'_i(n)$ is generated for comparison to the input speech vector, s(n). Gain block 211 scales the excitation vector $u_i(n)$ by the excitation gain factor $\gamma_i$, which is constant for a given frame. The scaled excitation signal $\gamma_i u_i(n)$ is then filtered by a long term predictor filter 213 and a short term predictor filter 215 to generate the reconstructed speech vector $s'_i(n)$. Long term predictor filter 213 utilizes the LTP coefficients to introduce voice periodicity. The short term predictor filter 215 utilizes the STP coefficients to introduce a spectral envelope.

The long-term predictor 213 attempts to predict the next output sample from one or more samples in the distant past. If only one past sample is used in the predictor, then the predictor is a single-tap predictor. Typically one to three taps are used. The transfer function for a long-term ("pitch") filter incorporating a single-tap long-term predictor is given by the following equation:

$$B(z)=\frac{1}{1-\beta z^{-L}} \tag{1}$$

B(z) is characterized by two quantities L and β. L is called the "lag". For voiced speech, L would typically be the pitch period or a multiple of it. L may also be a non integer value. If L is a non integer, an interpolating finite impulse response (FIR) filter is used to generate the fractionally delayed samples. β is the long-term (or "pitch") predictor coefficient.

The short-term predictor 215 attempts to predict the next output sample from the previous $N_p$ output samples. $N_p$ typically ranges from 8 to 12 with 10 being the most common value. The short-term predictor 215 is equivalent to a traditional LPC synthesis filter. The transfer function for the short-term filter is given by the following equation:

$$A(z)=\frac{1}{1-\sum_{i=1}^{N_p}\alpha_i z^{-i}} \tag{2}$$

The short-term filter is characterized by the α parameters, which are the direct form filter coefficients for the all pole "synthesis" filter.

The reconstructed speech vector $s'_i(n)$for the i-th excitation codevector is compared to a frame of the input speech vector s(n) by subtracting these two signals in subtractor 217. The difference vector $e_i(n)$ represents the difference between the original and the reconstructed blocks of speech. The difference vector $e_i(n)$ is weighted by the spectral noise weighting filter 219, utilizing the WFP coefficients generated by coefficient analyzer 205. The spectral noise weighting filter accentuates those frequencies where the error is perceptually more important to the human ear, and attenuates other frequencies. This weighting filter is a function of the speech spectrum and can be expressed in terms of the a parameters of the short term (spectral) filter.

$$W(z)=\frac{1-\sum_{i=1}^{N_p}\alpha_i z^{-i}}{1-\sum_{i=1}^{N_p}(0.8)^i\alpha_i z^{-i}} \tag{3}$$

An energy calculator 221 computes the energy of the spectrally noise weighted difference vector $e'_i(n)$ and applies this error signal $E_i$ to a codebook search controller 223. The codebook search controller 223 compares the i-th error signal for the present excitation vector $u_i(n)$ against previous error signals to determine the excitation vector producing the minimum weighted error. The code of the i-th excitation vector having a minimum error is then chosen as the best excitation code I.

Equivalently, the spectral noise weighting filter 219 may be moved above the subtractor block 217, into the input signal path (after coefficient analyzer block 205 but before the MSE modifier block 225) and into the synthetic signal path, immediately after the short term predictor block 215. In that case the short term predictor A(z) is cascaded with the spectral noise weighting filter W(z). Define the cascade of the short term predictor A(z) and the spectral noise weighting filter W(z) to be H(z), where:

$$H(z)=\frac{1}{1-\sum_{i=1}^{N_p}(0.8)^i\alpha_i z^{-i}}$$

In the preferred embodiment, a MSE modifier 225 is utilized to choose corresponding quantized gains, γ and β, for the chosen excitation code, I, using a gain bias factor χ. The quantized gains are selected to minimize the total weighted error energy at a subframe. Details of the MSE modifier 225 can be found below.

The weighted error per sample at a subframe is defined by $$e(n)=p(n)-\beta c'_0(n)-\gamma c'_1(n)\quad 0\leqq n\leqq N-1 \tag{4}$$

where s(n) is the input speech, p(n), is the weighted input speech vector, less the zero input response of H(z)

$c'_0(n)$ is the long term prediction vector weighted by zero-state H(z)

$c'_1(n)$ is the selected codevector weighted by zero-state H(z)

β is the long term predictor coefficient

γ is the gain scaling the codevector

Consequently the total weighted error squared for a subframe is given by $$E=\sum_{n=0}^{N-1}e^2(n)=\sum_{n=0}^{N-1}(p(n)-\beta c_0'(n)-\gamma c_1'(n))^2 \tag{5}$$

To simplify the error equation, E may be expressed in terms of correlations among vectors p(n), $c'_0(n)$, and $c'_1(n)$. Let $$R_{pp}=\sum_{n=0}^{N-1}p(n)p(n) \tag{6}$$

$$R_{pc}(k)=\sum_{n=0}^{n-1}p(n)c_k'(n)\ k=0,1 \tag{7}$$

$$R_{cc}(k,j)=\sum_{n=0}^{N-1}c_k'(n)c_j(n)\ k=0,1,j=k,1 \tag{8}$$

-continued $$R_{cc}(k,j) = R_{cc}(j,k) \quad (9)$$

Incorporating the correlations into the error expression yields $$E=R_{pp}-2\beta R_{pc}(0)-2\gamma R_{pc}(1)+2\beta\gamma R_{cc}(0,1)+\beta^2 R_{cc}(0,0)+\gamma^2 R_{cc}(1,1) \quad (10)$$

The correlation terms are fixed due to the fact that p(n) is a given, and $c'_0(n)$ and $c'_1(n)$ have been sequentially chosen. $\gamma$ and $\gamma$, however, do remain free floating parameters. It can be seen that minimizing E involves taking partial derivatives of E first with respect to $\beta$, then to $\gamma$, and setting the two resulting simultaneous linear equations equal to zero. Thus, minimizing the weighted error consists of jointly optimizing $\beta$, the long term predictor coefficient, and $\gamma$, the gain term. The interrelationship between $\gamma$ and $\beta$ is exploited by vector quantizing both parameters. The quantization of $\beta$ and $\gamma$ consists of computing the correlations required by E, and evaluating E for each of the codevectors in the $\{\beta,\gamma\}$ codebook. The vector minimizing the weighted error is then chosen.

One disadvantage of this approach is that the pitch predictor coefficient tends to be large in magnitude during the onset of voiced speech. The large variation in its value is not conducive to efficient coding. The second disadvantage is that $\gamma$ will vary with the signal power, thus, requiring large dynamic range for coding. A third disadvantage is that a transmission error affecting the gain parameters can cause a large energy error which may result in "blasting". Additionally, an error in $\beta$ can result in error propagation in the pitch predictor and possible long term filter instabilities. To circumvent these difficulties, the energy domain transforms of $\beta$ and $\gamma$ are the parameters being actually coded, as is explained in the following section.

Define ex(n) to be the excitation function at a given subframe and is a linear combination of the pitch prediction vector scaled by $\beta$, the long term predictor coefficient, and of the codevector scaled by $\gamma$, its gain. In equation form $$ex(n)=\beta c_0(n)+\gamma c_1(n) \quad 0\leqq n\leqq N-1 \quad (11)$$

where $c_0(n)$ is the unweighted long term prediction vector, $b_L(n)$ $c_1(n)$ is the unweighted codevector selected, $u_I(n)$ Further assume that $c_0(n)$ and $c_1(n)$ are uncorrelated. This is not true in general, but committing that assumption both at the transmitter and the receiver, mathematically validates the transgression.

The power in each excitation vector is given by $$R_x(k) = \sum_{n'0}^{N-1} c_k^2(n) \; k=0,1 \quad (12)$$

Let R be the total power in the coder subframe excitation $$R = \sum_{n=0}^{N-1} ex^2(n) = \sum_{n=0}^{N-1} (\beta c_0(n) + \gamma c_1(n))^2 \quad (13)$$

or equivalently (assuming orthogonality)

$$R=\beta^2 R_x(0)+\gamma^2 R_x(1) \quad (14)$$

P0, the power contribution of the pitch prediction vector as a fraction of the total excitation power at a subframe, may be then written as $$PO = \frac{\beta^2 R_x(0)}{R} \quad (15)$$

The fact that P0 is bounded makes it a more attractive coding parameter candidate than the unbounded $\beta$. R(0) is generated once per frame in the course of generating the LPC coefficients. The 170 sample window used in calculating R(0) is therefore centered over the last 100 samples of the frame. R(0) represents the average power in the input speech. Define $R'_q(\mathbf{0})$ to be the quantized value of R(0) to be used for the current subframe and $R_q(\mathbf{0})$ to be the quantized value of R(0). Then:

$R'_q(0)=R_q(0)$previous frame for subframe 1

$R'_q(0)=R_q(0)$current frame for subframes 2, 3, 4

Let RS be the approximate residual energy at a given subframe. RS is a function of N, the number of points in the subframe, $R'_q(\mathbf{0})$, and of the normalized error power of the LPC filter $$RS = NR_q'(0) \prod_{i=1}^{N_p} (1-r_i^2) \quad (16)$$

If the subframe length would equal frame length, R(0) was unquantized, $c_0(n)$ and $c_1(n)$ were uncorrelated, and the coder perfectly matched the residual signal, then R, the actual coder excitation energy would equal the residual energy due to the LPC filter; i.e.,

R=RS

In reality several factors conspire against that being the case. First, each frame over which R(0) is calculated spans 4 subframes. Thus R(0) represents the signal energy averaged over 4 subframes, the actual subframe residual energies deviating about RS. Secondly, R(0) is quantized to $R_q(\mathbf{0})$. Thirdly, the LPC filter coefficients are interpolated, and so the reflection coefficients in calculating RS, change at subframe rate. Finally the coder will not exactly match the residual signal, given a finite size codebook. This prompts the introduction of GS, the energy tweak parameter, to compensate for these deviations $$R = GSRS \rightarrow GS = \frac{R}{RS} \quad (17)$$

Thus $\beta$ and $\gamma$ are replaced by two new parameters: P0, the fraction of the total subframe excitation energy which is due to the long term prediction vector, and GS, the energy tweak factor which bridges the gap between R, the actual energy in the coder excitation, and RS, its estimated value. The transformations relating $\beta$ and $\gamma$ to P0 and GS are given by $$\beta = \sqrt{\frac{RSGSP0}{R_x(0)}} \quad (18)$$

$$\gamma = \sqrt{\frac{RSGS(1-P0)}{R_x(1)}} \quad (19)$$

Now the joint quantization of $\beta$ and $\gamma$ may be replaced by vector quantization of P0 and GS. One advantage of coding the {P0,GS} pair, is that P0 and GS are independent of the input signal level. The quantization of R(0) to $R_q(\mathbf{0})$ normalizes the absolute signal energy out of the vector quantization process. In addition P0 is bounded and GS is well behaved. These factors make {P0,GS} the parameters of choice for vector quantization.

Thus, the MSE modifier 225 uses an optimizer to solve for the jointly optimal gains $\beta_{opt}$ and $\gamma_{opt}$ using the following equation:

$$\begin{bmatrix} R_{cc}(0,0) & R_{cc}(0,1) \\ R_{cc}(1,0) & R_{cc}(1,1) \end{bmatrix} \begin{bmatrix} \beta_{opt} \\ \gamma_{opt} \end{bmatrix} = \begin{bmatrix} R_{pc}(0) \\ R_{pc}(1) \end{bmatrix} \tag{20}$$

Given $\beta_{opt}$ and $\gamma_{opt}$, a bias generator generates the gain bias factor $\chi$, formulated to force a better energy match between p(n) and the weighted synthetic excitation as given below. $T_l$ and $T_h$ are the lower and upper bounds for $\chi$ respectively. In the preferred embodiment $T_l$ is equal to 1.0 and $T_h$ is equal to 1.25.

$$\chi = \mathrm{Min}\left[T_h, \left(\mathrm{Max}\left[T_1, \sqrt{\frac{R_{pp}}{\beta_{opt}^2 R_{cc}(0,0) + \gamma_{opt}^2 R_{cc}(1,1) + 2\beta_{opt}\gamma_{opt} R_{cc}(0,1)}}\right]\right)\right] \tag{21}$$

Note that although the optimal gains, $\beta_{opt}$ and $\gamma_{opt}$, are explicitly computed in equation 20 and used in equation 21, equivalent solutions for $\chi$ may be formulated which do not require the explicit computation of the intermediate quantities, $\beta_{opt}$ and $\gamma_{opt}$. One equivalent solution for $\chi$, which does not require explicit computation of $\beta_{opt}$ and $\gamma_{opt}$ is given below:

$$\chi = \mathrm{Min}\left[T_h, \left(\mathrm{Max}\left[T_1, \sqrt{\frac{R_{pp}(R_{cc}(0,0)R_{cc}(1,1) - R_{cc}(0,1)R_{cc}(0,1))}{R_{cc}(0,0)R_{pc}(1)R_{pc}(1) - 2R_{cc}(0,1)R_{pc}(0)R_{pc}(1) + R_{cc}(1,1)R_{pc}(0)R_{pc}0)}}\right]\right)\right] \tag{21.1}$$

In that case the MSE modifier 225 evaluates equation 21.1 directly to generate the gain bias factor $\chi$, instead of evaluating equations 20 and 21. Equation 21.1 is the preferred embodiment for generating $\chi$.

An alternate interpretation of what the ratio under the square root operator in equations 21 and 21.1 represents is now given. This ratio is the energy in p(n), the weighted input speech vector to be matched, divided by the energy in the weighted reconstructed speech vector, assuming that optimal gains are being used for generating the weighted reconstructed speech vector. The energy in p(n) is $R_{pp}$. The energy in the weighted reconstructed speech may be explicitly computed as follows: the selected weighted codevector, multiplied by $\gamma_{opt}$, is added to the selected weighted long term predictor vector, scaled by $\beta_{opt}$, to yield the weighted reconstructed speech vector. Next the squares of the samples of the weighted reconstructed speech vector are summed to compute the energy in that vector. Equivalently the energy in the weighted reconstructed speech vector may be computed as follows: first the synthetic excitation vector is constructed, by adding the selected codevector, multiplied by $\gamma_{opt}$, to the selected long term predictor vector, scaled by $\beta_{opt}$, to yield the synthetic excitation vector. The synthetic excitation vector so constructed is then filtered by H(z), to yield the weighted reconstructed speech vector. The energy in the weighted reconstructed speech vector is computed by summing the squares of the samples in that vector. As already was stated, in practice it is more efficient to compute $\chi$ by evaluating equation 21.1, bypassing the computation of $\beta_{opt}$ and $\gamma_{opt}$, and without explicitly constructing the weighted reconstructed speech vector to compute the energy in it (or alternately without explicitly constructing the synthetic excitation vector and filtering that vector by H(z) to generate the weighted reconstructed synthetic speech vector to compute the energy in it.

Next, the MSE modifier 225 alters the weighted error equation which is used to select a vector from the GSP0 vector codebook, by incorporating the gain bias factor $\chi$ into correlation terms which are a function of p(n). Replacing the $\gamma$ and $\beta$ in equation 10 by the equivalent expressions in terms of GS, P0, and $R_x(k)$ and incorporating the gain bias factor $\chi$ results in the updated weighted error equation $$E = \chi^2 R_{pp} - a\sqrt{GSP0} - b\sqrt{GS(1-P0)} + c\,GS\sqrt{P0(1-P0)} + d\,GSP0 + e\,GS(1-P0) \tag{22}$$

where

-continued $$a = 2\chi R_{pc}(0)\sqrt{\frac{RS}{R_x(0)}}$$

$$b = 2\chi R_{pc}(1)\sqrt{\frac{RS}{R_x(1)}}$$

-continued $$c = \frac{2R_{cc}(0,1)RS}{\sqrt{R_x(0)R_x(1)}}$$

$$d = \frac{RSR_{cc}(0,0)}{R_x(0)}$$

$$e = \frac{RSR_{cc}(1,1)}{R_x(1)}$$

Note that introducing $\chi$ into equation 22 is equivalent to explicitly multiplying (or adjusting) p(n) by the gain adjustment factor $\chi$, prior to computing those correlation terms which are a function of p(n)- $R_{pp}$ and $R_{pc}(k)$ - and then evaluating equation 22 (setting $\chi$ to 1 in equation 22), to find a vector in the gain quantizer which minimizes the weighted error energy E. Incorporating $\chi$ into equation 22 results in a more efficient implementation, however, because only the correlation terms are being multiplied (adjusted) instead of the actual samples of p(n). It is more efficient because typically there are much fewer correlation terms which are a function of p(n) than there are samples in p(n).

Four separate vector quantizers for jointly coding P0 and GS are defined, one for each of four voicing modes. The first step in quantizing of P0 and GS consists of calculating the parameters required by the error equation:

$R_{cc}(k,j)$ $k=0,1,$ $j=k,l$ $R_x(k)$ $k=0,1$ $RS$ $R_{pc}(k)$ $k=0,1$ $a,b,c,d,e$

Next equation (22) is evaluated for each of the 32 vectors in the {P0,GS} codebook, corresponding to the selected voicing mode, and the vector which minimizes the weighted error is chosen. Note that in conducting the code search $\chi^2 R_{pp}$ may be ignored in equation (22), since it is a constant. $\beta_q$, the quantized long term predictor coefficient, and $\gamma_q$, the quantized gain, are reconstructed from $$\beta_q = \sqrt{\frac{RSGS_{vq}P0_{vq}}{R_x(0)}} \tag{23}$$

$$\gamma_q = \sqrt{\frac{RSGS_{vq}(1-P0_{vq})}{R_x(1)}} \tag{24}$$

where $P0_{vq}$ and $GS_{vq}$ are the elements of the vector chosen from the {P0,GS} codebook.

A special case occurs when the long term predictor is disabled for a certain subframe, but voicing Mode 0 is not selected. This will occur when the state of the long term predictor is populated entirely by zeroes. For that case, the deactivation of the pitch predictor yields a simplified weighted error expression.

$$E = \chi^2 R_{pp} - b\sqrt{GS} + e\,GS \tag{25}$$

In order to maximize similarity to the case where the pitch predictor is activated, a modified form of equation (25) is used:

$$E \cong \chi^2 R_{pp} - b\sqrt{GS(1-P0)} + e\,GS(1-P0) \tag{26}$$

The use of equation (26) instead of (25) allows the use of the same codebook regardless of whether the pitch predictor has been deactivated, and voicing Mode 0 is not selected. This is especially helpful when the codebook contains all the error term coefficients in precomputed form. For this case the quantized codevector gains are:

$$\beta_q = 0 \tag{27}$$

$$\gamma_q = \sqrt{\frac{RSGS_{vq}(1-P0_{vq})}{R_x(1)}}\ . \tag{28}$$

The use of the gain bias factor has been demonstrated for the case where the synthetic excitation is constructed as a linear combination of the two excitation sources: the long term prediction vector scaled by $\beta$ and the excitation codevector scaled by $\gamma$. The method of applying the gain bias factor which is described in this application may be extended to an arbitrary number of excitation sources. The synthetic excitation may consist of a long term prediction vector, a combination of the long term prediction vector and at least one codevector, a single codevector, or a combination of several codevectors.

The use of the gain bias factor has been demonstrated for the case where the gains are vector quantized in a specific way—using the P0-GS methodology. The method of gain bias factor may be beneficially used in conjunction with other methods of quantizing the gains, such as but not limited to direct vector quantization of the gain information or scalar quantization of the gain information.

The use of the gain bias factor in the preferred embodiment assumes that the gains are jointly optimal when computing the gain bias factor $\chi$. Other assumptions may be used. For example, the gain quantizer (vector or scalar) may be searched once, without using the gain bias factor, to obtain the quantized values of $\beta$ and $\gamma$, with $\beta_q$ replacing $\beta_{opt}$ and $\gamma_q$ replacing $\gamma_{opt}$ in equation 21 to compute $\chi$. Using the value of $\chi$ so computed, the gain quantizer(s) may be searched the second time to select $\beta_q$ and $\gamma_q$, which will be used to construct the actual synthetic excitation.

Thus, modifying the MSE criterion for the selected speech coder parameters provides a more accurate replication of human speech. Specifically, the modification emphasizes the signal segments that the speech coder has difficulty matching. This emphasis is constrained to certain limitations to avoid over-emphasizing the speech.

While a particular embodiment of the present invention has been shown and described, modifications may be made and it is therefore intended in the appended claims to cover all such changes and modifications which fall within the true spirit and scope of the invention.

What is claimed is:

1. A method of matching energy of speech coding vectors to an input speech vector comprising the steps of:

choosing a codevector to represent the input speech vector;

optimizing a long term predictor coefficient and a gain term for the codevector, thereby forming an optimized long term predictor and an optimized gain term; and determining a gain bias factor to more closely match an energy of the code vector to an energy of the input speech vector; and altering the optimal long term predictor coefficient and the optimal gain term using the gain bias factor.

2. The method of claim 1 wherein the step of determining a gain bias factor further comprises the steps of:

forming a synthetic excitation signal using the codevector, the optimal long term predictor and the optimal gain term;

calculating the energy of the input speech vector, forming a speech data energy value;

calculating the energy of the synthetic excitation signal, forming a synthetic excitation energy value;

calculating a ratio of the speech data energy value and the synthetic excitation energy value; and determining the square root of the ratio, forming the gain bias factor.

3. The method of claim 2 wherein the step of determining a gain bias factor further comprises the step of limiting the ratio value between an upper bound and a lower bound.

4. The method of claim 2 wherein the step of altering further comprises:

adjusting the input speech vector by the gain bias factor, thereby forming an adjusted input speech vector; and quantizing the optimal long term predictor coefficient and the optimal gain term to minimize the error between the adjusted input speech vector and the synthetic excitation signal.

5. A method of speech coding comprising the steps of:

receiving a speech data signal;

providing excitation vectors in response to said step of receiving;

determining an excitation gain coefficient and a long term predictor coefficient for use by a long term predictor filter and a Pth-order short term predictor filter;

filtering said excitation vectors utilizing said long term predictor filter and said short term predictor filter, forming filtered excitation vectors;

comparing said filtered excitation vectors to said speech data signal, forming difference vectors;

calculating energy of said filtered difference vectors, forming an error signal;

choosing an excitation code, I, using the error signals, which best represents the received speech data;

calculating optimal excitation gain and optimal long term predictor gain for the chosen excitation codebook vector;

forming a synthetic excitation signal using said chosen excitation code, the optimal excitation gain and said optimal long term predictor gain;

calculating an energy of the speech data signal, forming a speech data energy value;

calculating an energy of the synthetic excitation signal, forming a synthetic excitation energy value;

determining a gain bias factor to more closely match the speech data energy value and the synthetic excitation energy value; and quantizing the optimal excitation gain and the optimal long term predictor gain to minimize the error between the speech data signal and the synthetic excitation signal.

6. A speech coder for providing a codevector and associated gain terms in response to an input speech vector, the speech coder comprising:

a codebook search controller for choosing a codevector to represent the input speech vector;

a mean square error (MSE) modifier comprising:

an optimizer for optimizing a long term predictor coefficient and a gain term for the codevector, thereby forming an optimized long term predictor and an optimized gain term;

a bias generator for determining a gain bias factor to more closely match an energy of the code vector to the input speech vector; and an alterer for altering the optimal long term predictor coefficient and the optimal gain term using the gain bias factor.

7. A method of matching energy of a reconstructed speech vector to an input speech vector comprising the steps of:

choosing at least one codevector to represent the input speech vector;

determining a gain term for each of the at least one codevector;

combining the chosen codevector, using the corresponding codevector gain term(s), to produce a combined excitation vector;

filtering the combined excitation vector to produce a reconstructed speech vector, determining a gain bias factor to more closely match an energy of the reconstructed speech vector to an energy of the input speech vector; and altering the gain term using the gain bias factor.

8. A method of matching energy of a reconstructed speech vector to an input speech vector comprising the steps of:

choosing at least one codevector to represent the input speech vector;

determining a long term predictor coefficient and a gain term for each of the at least one codevectors;

combining a long term predictor vector and the chosen codevector(s), using the long term predictor coefficient and the codevector gain term(s) to produce a combined excitation vector;

filtering the combined excitation vector to produce a reconstructed speech vector;

determining a gain bias factor to more closely match an energy of the reconstructed speech vector to an energy of the input speech vector; and altering the long term predictor coefficient and the gain term using the gain bias factor.

9. The method of claim 8 where at least one of the at least one codevectors is the long term prediction vector.

10. The method of claim 8 wherein the step of determining a gain bias factor further comprises the steps of:

forming a synthetic excitation signal using the codevector, the optimal long term predictor and the optimal gain term;

calculating the energy of the input speech vector, forming a speech data energy value;

calculating the energy of the synthetic excitation signal, forming a synthetic excitation energy value;

calculating a ratio of the speech data energy value and the synthetic excitation energy value; and calculating a square root of the ratio, forming the gain bias factor.

11. The method of claim 10 wherein the step of determining a gain bias factor further comprises the step of limiting the ratio between an upper bound and a lower bound.

12. The method of claim 10 wherein the step of altering further comprises:

adjusting the input speech vector by the gain bias factor, thereby forming an adjusted input speech vector; and quantizing the optimal long term predictor coefficient and the optimal gain term to minimize the error between the adjusted input speech vector and the synthetic excitation signal.

13. A method of speech coding comprising the steps of:

receiving a speech data signal;

providing excitation vectors in response to said step of receiving;

determining an excitation gain coefficient and a long term predictor coefficient for use by a long term predictor filter and a Pth-order short term predictor filter;

filtering said excitation vectors utilizing said long term predictor filter and said short term predictor filter, forming filtered excitation vectors;

comparing said filtered excitation vectors to said speech data signal, forming difference vectors;

calculating energy of said difference vectors, forming an error signal;

choosing an excitation code, I, using the error signals, which best represents the received speech data;

calculating optimal excitation gain and optimal long term predictor gain for the chosen excitation codebook vector;

forming a synthetic excitation signal using said chosen excitation code, the optimal excitation gain and said optimal long term predictor gain;

filtering a synthetic excitation signal to form a synthetic speech signal, calculating an energy of the speech data signal, forming a speech data energy value;

calculating an energy of the synthetic speech signal, forming a synthetic speech energy value;

determining a gain bias factor to more closely match the speech data energy value and the synthetic speech energy value;

adjusting speech data signal based on a gain bias factor; and quantizing the excitation gain and the long term predictor gain to minimize the error between the adjusted speech data signal and the synthetic speech signal.

* * * * *